US007086318B1

(12) United States Patent
Darnall

(10) Patent No.: US 7,086,318 B1
(45) Date of Patent: Aug. 8, 2006

(54) ANTI-TANK GUIDED MISSILE WEAPON

(75) Inventor: Larry N. Darnall, Santa Clara, CA (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 0 days.

(21) Appl. No.: 10/097,814

(22) Filed: Mar. 13, 2002

(51) Int. Cl.
*F41F 3/04* (2006.01)

(52) U.S. Cl. ..... 89/1.815; 89/40.04

(58) Field of Classification Search ..... 89/1.815, 89/1.816, 40.03
See application file for complete search history.

(56) References Cited

U.S. PATENT DOCUMENTS

| | | | | |
|---|---|---|---|---|
| 4,019,422 | A * | 4/1977 | Magnuson | 89/1.815 |
| 4,472,632 | A * | 9/1984 | Durenec | 250/333 |
| 4,574,685 | A * | 3/1986 | Sanborn et al. | 89/37.14 |
| 4,576,085 | A * | 3/1986 | LeBlanc | 89/36.13 |
| 4,583,444 | A * | 4/1986 | Jackson | 89/36.13 |
| 4,638,715 | A * | 1/1987 | LeBlanc | 89/41.12 |
| 4,733,596 | A * | 3/1988 | Crow et al. | 89/34 |
| 4,772,942 | A * | 9/1988 | Tuck | 348/38 |
| 4,983,837 | A * | 1/1991 | Cooper et al. | 250/334 |
| 5,042,742 | A * | 8/1991 | Hufault et al. | 244/3.11 |
| 5,042,743 | A * | 8/1991 | Carney | 244/3.11 |
| 5,175,600 | A * | 12/1992 | Frank et al. | 356/153 |
| 5,949,015 | A * | 9/1999 | Smith et al. | 89/41.05 |
| 6,584,881 | B1 * | 7/2003 | Boudreau et al. | 89/1.804 |
| 6,769,347 | B1 * | 8/2004 | Quinn | 89/41.05 |

FOREIGN PATENT DOCUMENTS

JP 01046595 A * 2/1989

OTHER PUBLICATIONS

"Forward Looking Infrared (FLIR)", no date, no author.*
"How Night Vision Works", Jeff Tyson, no date.*
EMX Inc. article: Thermal Imaging Training, Law and Order (Dec. 1998) vol. 46, No. 12, p. 49; Van Dover.*
"Bradley Fighting Vehicle Getting New Eyes", National Defense, Sep. 2000.*
VCC 80 Dardo HITFIST, Military Analysis Network, Sep. 1999.*

(Continued)

*Primary Examiner*—Troy Chambers
(74) *Attorney, Agent, or Firm*—Patterson, Thuente, Skaar & Christensen, P.A.

(57) ABSTRACT

An anti-tank guided missile (ATGM) weapon system with an overhead mounted, electrically driven, remote controlled weapon station that supports a tube-launched optically-tracked wire-guided (TOW) missile launcher and a machine gun, typically the caliber .50 M2, on a single traversing and elevating platform. Above-deck assemblies include the TOW and gun cradle, a dual pod missile launcher, the Improved Target Acquisition System (ITAS), target acquisition subsystem (TAS), elevation and traverse motors and gear transmissions and drive electronics, and an ammunition case. Below-deck assemblies include the ATGM weapon system control handles, biocular display, control panel, ITAS fire control system (FCS), ITAS battery power source (BPS), slip-ring, and gunner's seat. Electrical cables connecting the two assemblies penetrate the vehicle deck directly below the weapon System.

6 Claims, 6 Drawing Sheets

OTHER PUBLICATIONS

Defense Systems Press Release, Jun. 1999.*
New Armored Vehicles Debut, Armor, Jan-Feb. 1998.*
PCT Application WO 94/17357, Aug. 1994, Aspehaug.*
Army Technology, http://www.army-technology.com/projects/stormer30/, no date.*
GM Defense—Delco Systems, http://www.delcosystems.com/DS-v3/ETS.htm, updated Jan. 2001.*
Oto Melara Products, http://www.otomelara.it/products/products.asp?pid=41, no date.*
Army Technology, http://www.army-technology.com/projects/dardo/index.html.*
Raytheon Publication, "TOW 2 Weapon System", cleared for publication in 2000.*
Delco article, http://www.global-defence.com/pages/delco.html.*
Army Technology—Kvaerner Eureka article, http://www.army-technology.com/contractors/turrets/kvaerner/.*
"M-220 Tube Launched, Optically tracked, Wire-guided missile (TOW)", FAS Military Analysis Network, Feb. 22, 2000.*
Photograph of M901 vehicle at http:www.armyrecognition.com/ . . . (Mar. 2002).*

* cited by examiner

ANTI-TANK GUIDED MISSILE WEAPON

BACKGROUND OF THE INVENTION

1. Field of the Invention

The present invention relates generally to military equipment, and more particularly to an anti-tank guided missile (ATGM) weapon system that includes an overhead mounted, electrically driven, remote controlled weapon station mounting a tube-launched optically-tracked wire-guided (TOW) missile launcher and a caliber .50 M2 machine gun on a single traversing and elevating platform.

2. Description of the Prior Art

There is no known approach that integrates an Improved Target Acquisition System (ITAS) with a dual pod TOW missile launcher on a remotely operated platform. This approach also integrates a caliber .50 M2 machine gun on the same platform as the TOW missiles. The system also allows the user to accomplish target acquisition and engagement from under armor.

Prior art systems include Kvaerner Eureka's manned ATGM turret known as the Armored Launching Turret (ALT), Emerson's 901A1 Turret System, and Delco's LAV-25 TOW Turret System.

Kvaerner Eureka's ALT is a one man turret with two single TOW missile launchers. This system offers the capability of integrating ITAS. The ALT utilizes a large, tall, heavy turret, thereby making the system difficult and complex to integrate into a vehicle that can be quickly configured for C130 transport. The ALT also requires a very large volume within the vehicle on which it is used.

Emerson's 901A1 Turret System is also a one man turret with two single TOW launchers. This system has been phased out of the U.S. Army's inventory due primarily to poor reliability and high maintenance requirements. The system is a large, heavy, complex system which does not offer ITAS capability.

The LAV-25 TOW Turret System from Delco is a two-man turret which includes integrated TOW capability with two single missile launchers. The LAV-25 weapons include a 25 mm cannon and a co-axial 7.62 mm machine gun. This system also utilizes a heavy turret that necessitates a large space allotment inside and on top of the vehicle. The system does not have the capability of integrating ITAS.

Accordingly, it is an object of the present invention to provide an ATGM weapon system that is capable of defeating main battle tanks at ranges of up to 3,750 meters. The ATGM shall mount a minimum of two missiles in the launcher, and the launcher shall be capable of firing the TOW family of missiles. The ATGM must not degrade the performance of the TOW missile, so that the probability of a hit given a shot must be equal to or greater than a TOW 2B fired from ITAS.

It is a further object of the present invention to provide a system in which the primary armament is capable of engaging targets at elevations from at least −20 to at least +29 degrees.

It is a still further object of the present invention to provide a system with a target acquisition system that can survive shock/vibration loads while mounted on a moving vehicle.

It is yet another object of the present invention to provide a system in which the gunner can aim, fire, and guide missiles to the target from under armor within the vehicle. An individual crewman must be able to reload two missiles within two minutes with minimum exposure to the crewman.

It is yet another object of the present invention to provide a weapon system with interlocks for no-fire zone restrictions and to preclude firing the primary or secondary weapons with the hatches open. Manual firing of the secondary weapon (machine gun) is acceptable with open hatch conditions.

SUMMARY OF THE INVENTION

The present invention is an anti-tank guided missile (ATGM) weapon system comprising an overhead mounted, electrically driven, remote controlled weapon station that supports a tube-launched optically-tracked wire-guided (TOW) missile launcher and a machine gun, typically the caliber .50 M2, on a single traversing and elevating platform. The ATGM weapon system is comprised of above-deck and below-deck assemblies.

The above-deck assembly includes the TOW and gun cradle, a dual pod missile launcher, the Improved Target Acquisition System (ITAS), target acquisition subsystem (TAS), elevation and traverse motors and gear transmissions and drive electronics and axles and bearings, and an ammunition case. The weapons are driven through an elevation range of −20 degrees to +60 degrees. While the caliber .50 weapon can be fired throughout the elevation range, the TOW launcher is inhibited from firing above 30 degrees elevation.

The below-deck assemblies include the ATGM weapon system control handles, biocular display, control panel, ITAS fire control system (FCS), ITAS battery power source (BPS), slip-ring, and gunner's seat. Electrical cables connecting the two assemblies penetrate the vehicle deck directly below the weapon System.

A major advantage of the ATGM of the present invention is the TOW two-missile launcher that is mounted on a compact, lightweight, remotely operated platform. The ATGM weapon system provides the capability for the ATGM gunner to fire both the TOW and the caliber .50 secondary weapon from under armor. This system was arrived at by integrating features of the proven M2/M3 Bradley Fighting Vehicle two-tube TOW missile launcher (TML) with an Enhanced Improved Target Acquisition System (EITAS) and the caliber .50 M2 heavy barrel machine gun. The EITAS adds features to ITAS that allow the weapon system of the present invention to be operated by a gunner from a remote location.

Another advantage of the present invention is that due to the weapon station being fabricated from simple aluminum plate, and the control hardware being assembled from proven components, there is a low risk in providing the system with under armor TOW capability.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
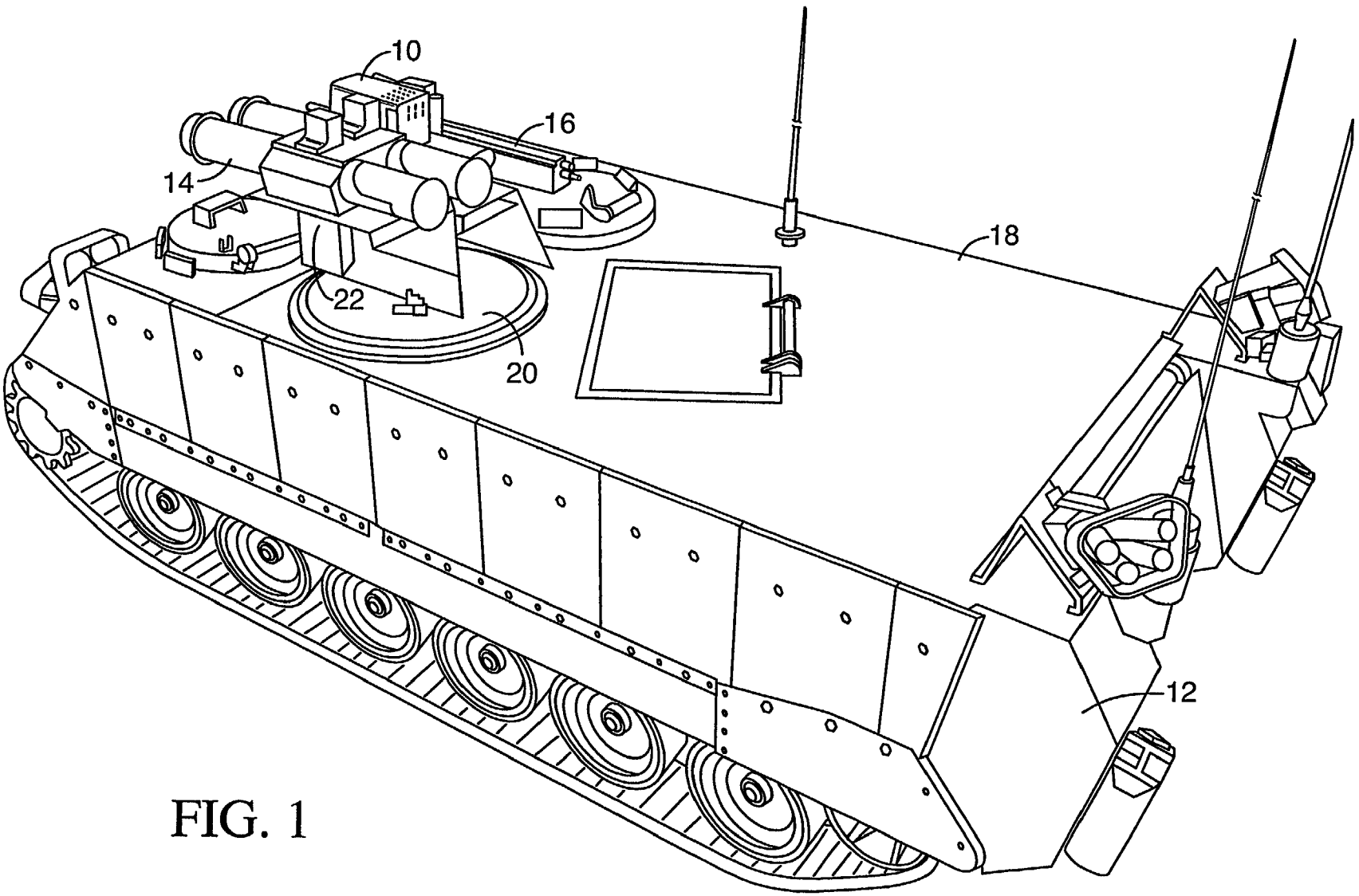
FIG. 1 is a perspective view of the ATGM of the present invention mounted on a C130 transport vehicle.
Figure 2:
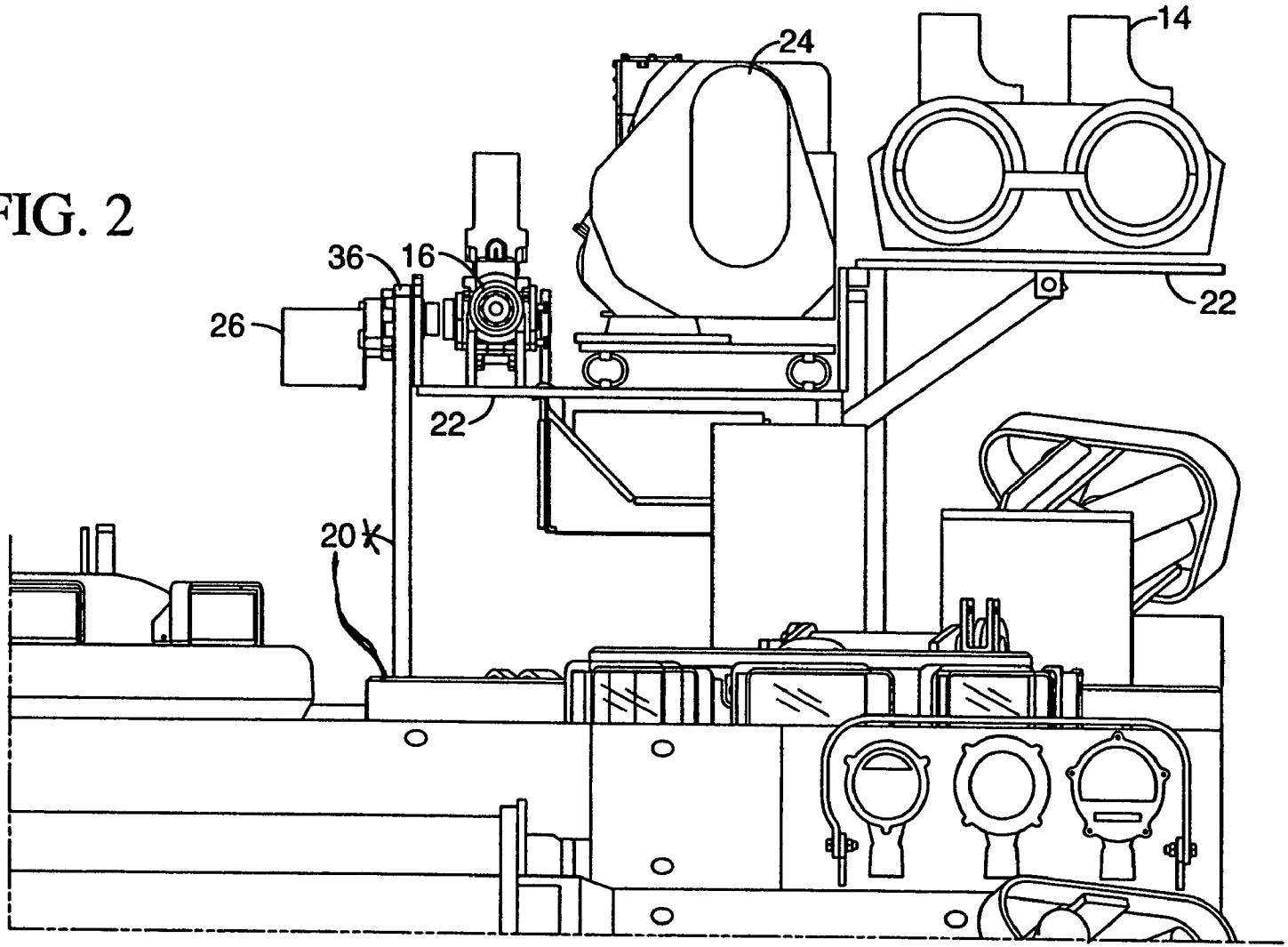
FIG. 2 is a detail view showing the weapon systems mounted on the traversing and elevating platform.

Referring first generally to FIGS. 1–5, the present invention is an anti-tank guided missile (ATGM) weapon system 10 mounted on a C130 transport vehicle 12. The weapon system 10 of the present invention enables the gunner to fire a TOW missile launcher (TML) 14 and a secondary weapon 16 from under armor, beneath the deck 18 of the transport vehicle 12. In the preferred embodiment, the secondary weapon 16 is a caliber .50 M2 machine gun.

The ATGM weapon system 10 is an electrically driven, remote controlled weapon station. The two-tube TOW missile launcher 14 and the caliber .50 machine gun 16 are mounted on a single traversing and elevating platform 20, shown in an enlarged view in FIG. 2. The ATGM weapon system 10 comprises several above-deck and below-deck components. The above-deck assemblies includes at least a weapon cradle 22, the TOW missile launcher and armament control unit (ACU) 14, the secondary weapon 16, and an enhanced improved target acquisition system 24 (EITAS, described in further detail below), all mounted on the platform 20.

Also mounted above-deck are the control and drive mechanisms 26 for the traversing and elevating platform 20, including traverse and elevation drives, gear transmissions, axles and bearings, and the drive electronics. The electromechanical design of the traverse and elevation drives was chosen to provide excellent reliability and high performance in field service. The drive mechanism modules can be replaced in the field with standard tools. The identical traverse and elevation drive modules each contain gearbox/driving mechanism, motor housing, and brake assembly submodules.

The electrical power to operate the traverse and elevation drive motors is 28 VDC chassis power. The drive mechanisms provide an acceleration rate of 1.0-rad/sec$^2$ and a slew rate in excess of 30 degrees per second. The stiffness and low backlash characteristics of the drive mechanism support static gun pointing accuracy and disturbance rejection.

The elevation pivot is composed of coaxial trunnions 36 located on opposite sides of the weapons 14, 16. The elevation drives achieve accuracy, stiffness and weight reduction by the strategic selection and placement of the mounting points, materials, and design configuration. Integration of a rigid sector gear with the trunnion is of prime importance in achieving the required accuracy. The elevation drive inertia demands only a small percent of the torque capability of the drive mechanism. Residual torque capacity holds the weapon during firing cycles.

The electronic portions of the drive control system use field-proven modular hardware and software with reserve capacity. Test points are available for fast troubleshooting. The software consists of mature, extensively tested modules.

Figure 3:
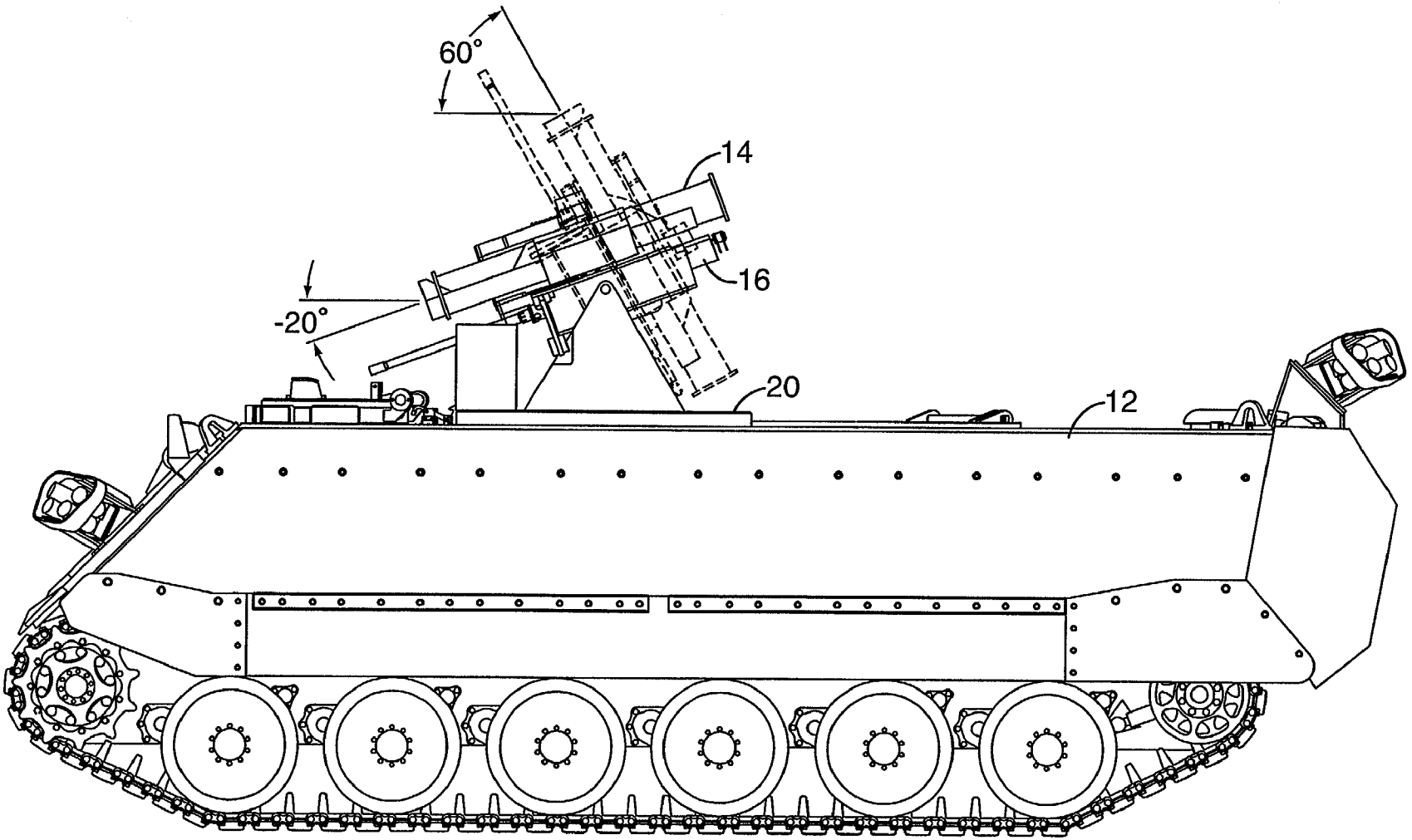
FIG. 3 illustrates the elevation range of the weapons.

As is illustrated in FIG. 3, the drive mechanisms of the ATGM system allow the TML 14 and the machine gun 16 to be driven through an elevation range of −20 degrees to +60 degrees. The caliber .50 weapon 16 can be fired throughout the complete elevation range; however, the TOW launcher 14 is inhibited from firing above 30 degrees elevation.

Figure 4:
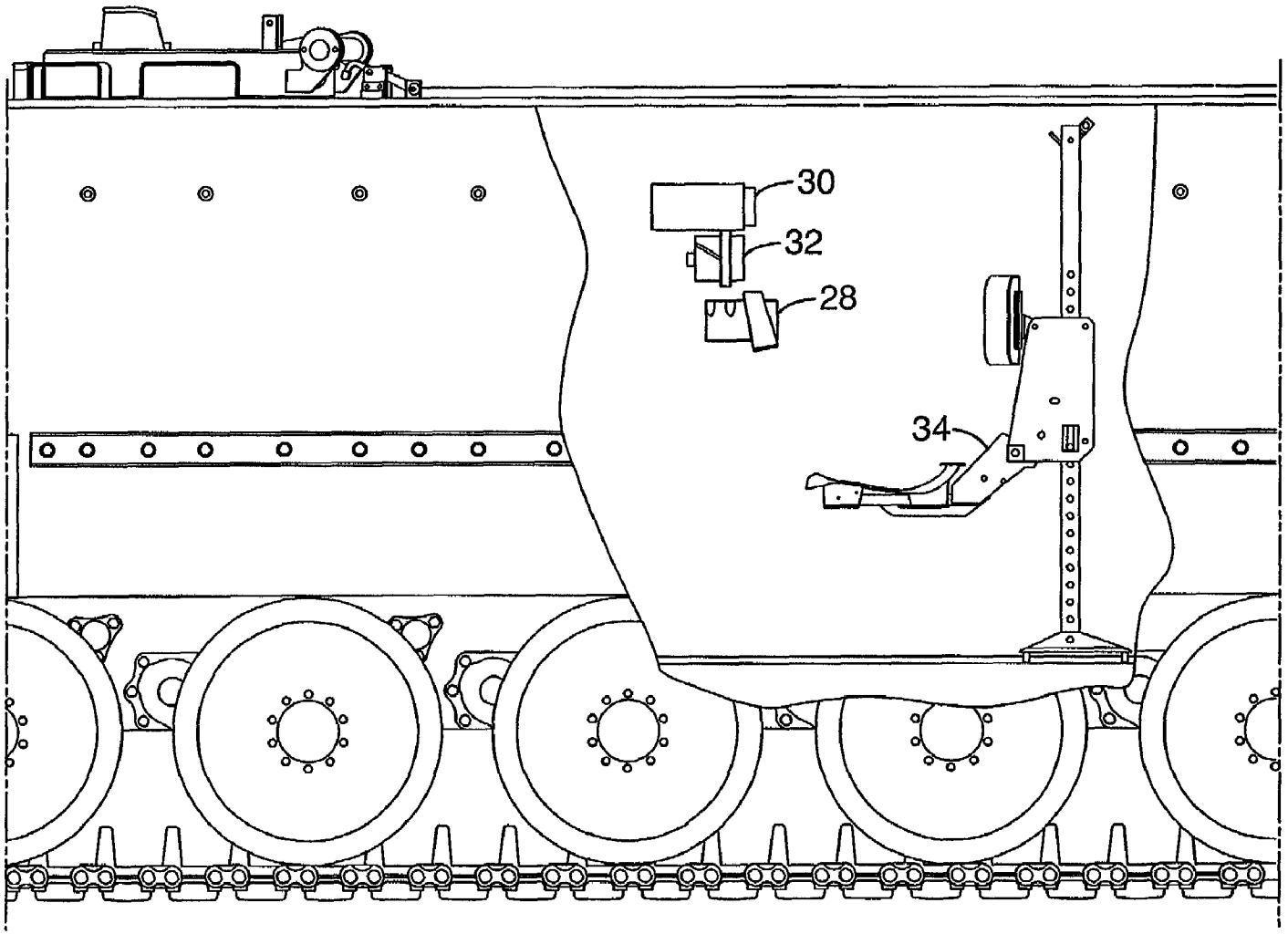
FIG. 4 shows the under armor gunner's station.

The below-deck assemblies of the ATGM weapon system 10, which are most easily seen in FIG. 4, include weapon control elements such as the ATGM weapon system control handles 28, a biocular display 30, and a control panel 32. An adjustable gunner's seat 34 is mounted below-deck so as to provide the gunner with easy access to the weapon control elements. The ITAS fire control system (FCS) and battery power source (BPS) are also installed below-deck. Electrical cables passing through the transport vehicle deck 18 connect the below-deck assemblies to the above-deck assemblies described above. The electrical cables pass through the vehicle deck 18 directly below the weapon system 10. A slipring (not shown) is provided at the cable pass-through point so that the cables are not sheared when the traversing and elevating platform 20 rotates.

Figure 5:
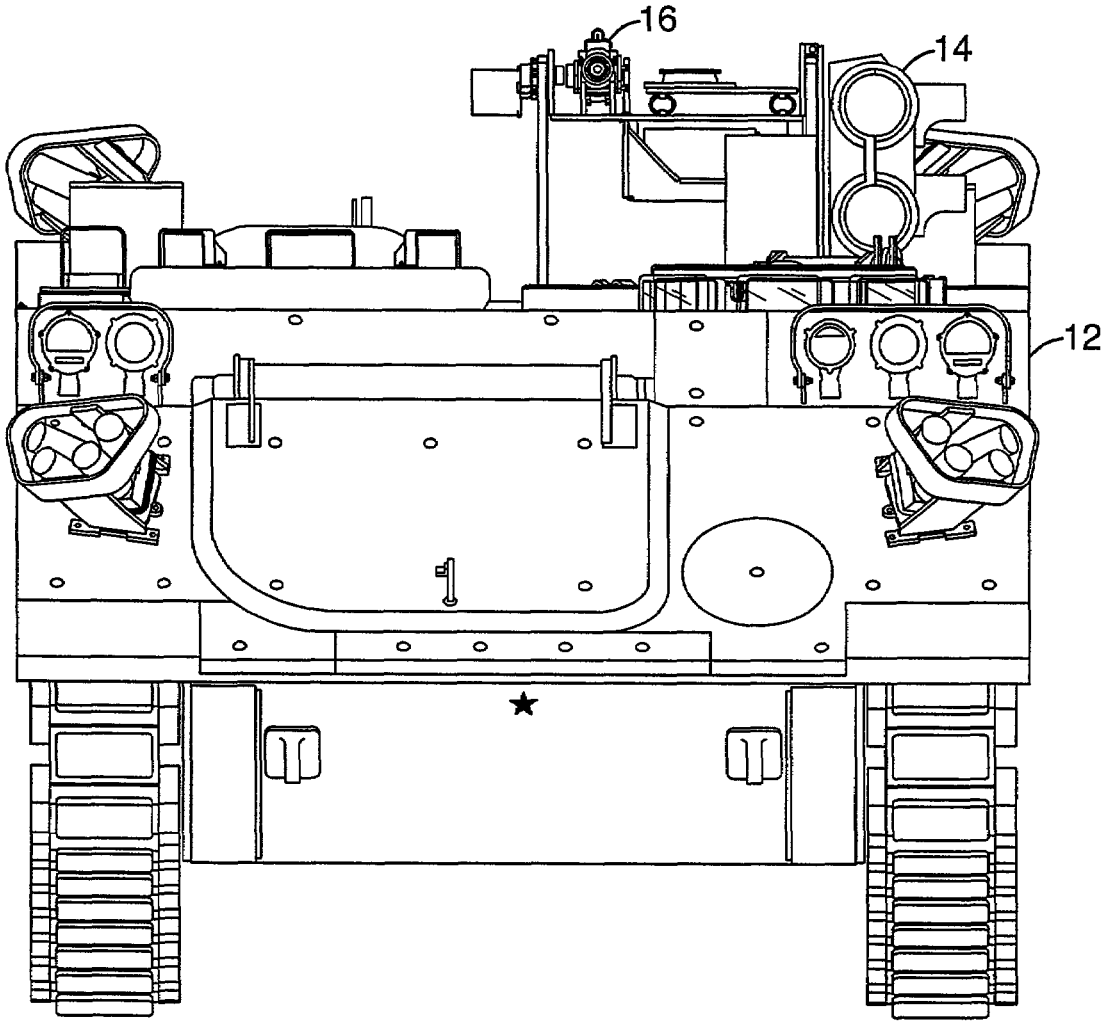
FIG. 5 shows the C130 with the weapons system in a transport configuration.

To place the ATGM weapon system 10 in the transport position shown in FIG. 5, the ITAS 24 is removed from the weapon station and stored in a shipping container inside the vehicle. The strut supporting the TML platform is removed, and the TML 14 is lowered to the stowed position illustrated in FIG. 5. Each of the processes, configuring the weapon station for transport and returning it to an operational position, are estimated to take two crew members three minutes.

Figure 6:
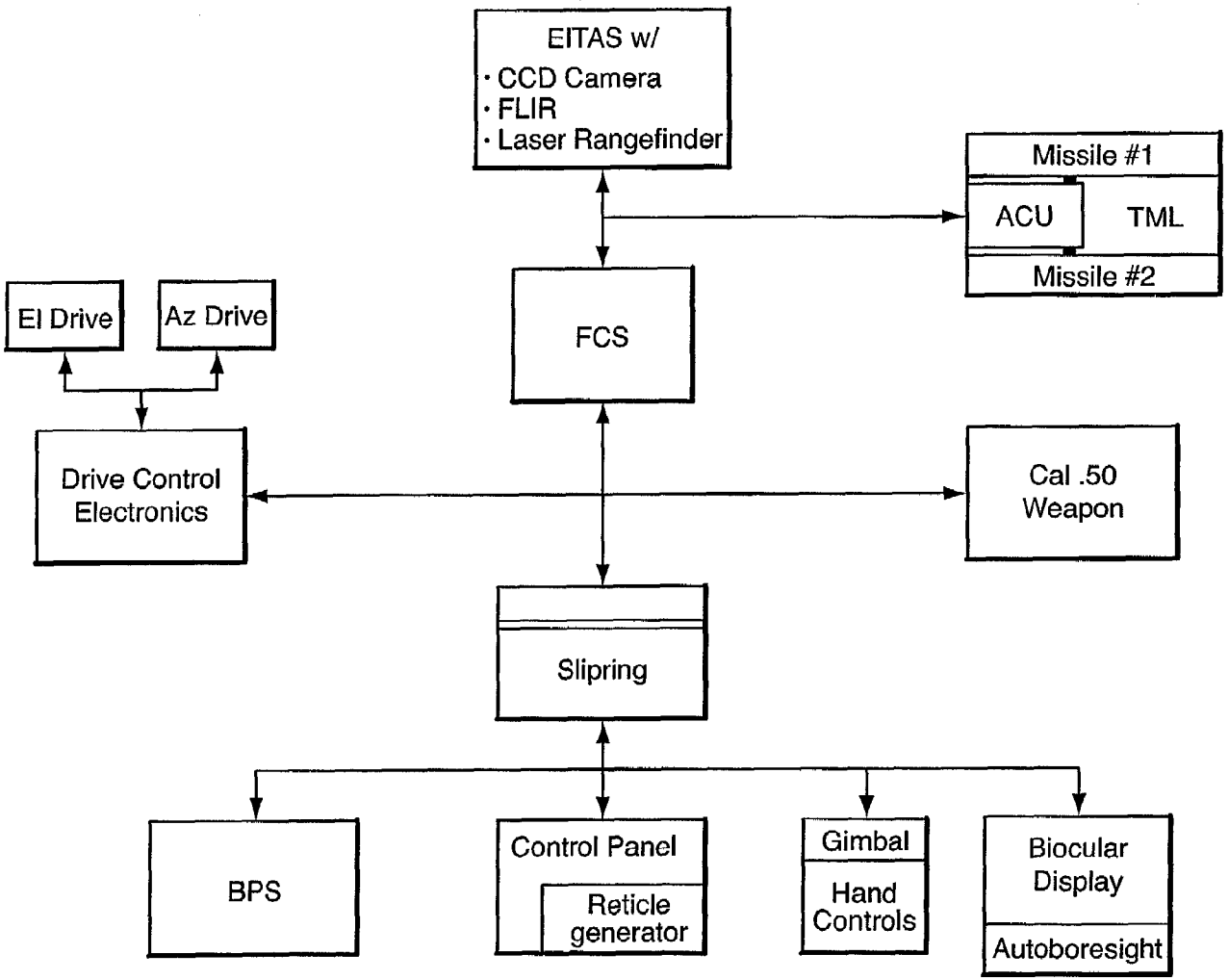
FIG. 6 is a block diagram of the ATGM weapons system.

FIG. 6 is a block diagram of the operation of the ATGM weapon system 10. The EITAS 24 has been constructed so as to be able to provide two missile firing capability as well as firing the .50 cal machine gun on the common platform 20. The EITAS 24 comprises at least an ITAS Fire Control System (FCS) and drive control electronics as above-deck components.

Below-deck components include the Battery Power Supply (BPS), the control panel with a reticle generator, gimbal mounted hand controls, and the biocular display. The weapon control panel includes the controls for turning on power to the EITAS, selecting TOW or .50 Cal, and selecting Missile #1 or #2 when TOW is selected. The hand controls include all the controls required to slew and elevate the weapon system, set up and fire the TOW, and fire the .50 cal weapon. The gimbal provides two degrees of rotation to the handles for driving the weapon station in azimuth and elevation. The biocular display presents the image received from the EITAS to the gunner. When the caliber .50 gun is selected, a stadiametric reticle is generated by the weapon system control panel and overlayed on the display.

As improvements over the components found in current level target acquisition systems, the EITAS of the present invention is equipped with a second generation forward looking infrared (FLIR) system. In addition, the biocular display includes an eyesafe laser rangefinder and an autoboresight subsystem for increased probability of a hit over existing systems. Other key features of the EITAS functional software include aided target tracking, embedded training, and BIT/BITE diagnostics. The EITAS module also includes a CCD camera to enable remote (below-deck) viewing of the day visual channel on the biocular display 30.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. An anti-tank guided missile weapon system comprising:

an armored vehicle having an armored deck;

an unarmored, light weight, above-deck mounted weapon station, said weapon station comprising at least a two-tube launched optically-tracked wire-guided missile launcher and a machine gun type weapon, the missile launcher and the machine gun weapon being both mounted on a weapons cradle on a single traversing and elevating platform, and a target acquisition system;

a single below-deck operator's station for controlling said weapon station, the operator's station being remotely disposed relative to said weapon station below the armored deck, including manual weapons system controls, fire control system, weapons system control panel, biocular display and gunner's seat; and communications operably coupling the weapon station to the operator's station penetrating the armored deck beneath the weapon station via a slip ring.

2. The weapon of system of claim 1, wherein:

an elevation angle of said missile launcher and said secondary weapon is adjustable through a range from minus twenty degrees to plus sixty degrees relative to a mounting deck of said transport vehicle.

3. The weapon system of claim 1, wherein:

said traversing and elevating platform is operated by a drive system comprising at least a first drive module to rotate said platform in a plane parallel to a mounting deck of said transport vehicle, and a second drive module to rotate said weapon cradle of said platform in a place perpendicular to said mounting deck, thereby allowing aiming of said weapon station through three axes.

4. The weapon system of claim 3, wherein:

said weapon station further includes an eyesafe laser rangefinder.

5. The weapon system of claim 1, wherein:

an elevation pivot comprises a first trunnion located on one side of said weapon cradle and a second trunnion located on an opposite side of said weapon cradle.

6. The weapon system of claim 1, wherein:

said weapon station is readily collapsible from a weapons ready position to a transport position, said transport position being more compact than the ready weapons position.

* * * * *